US010808929B2

(12) United States Patent
Kamoi et al.

(10) Patent No.: US 10,808,929 B2
(45) Date of Patent: Oct. 20, 2020

(54) STRUCTURE FOR COOLING GAS TURBINE ENGINE

(71) Applicant: HONDA MOTOR CO., LTD., Tokyo (JP)

(72) Inventors: Yasuharu Kamoi, Wako (JP); Koji Murata, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 592 days.

(21) Appl. No.: 15/220,542

(22) Filed: Jul. 27, 2016

(65) Prior Publication Data

US 2018/0031237 A1 Feb. 1, 2018

(51) Int. Cl.

| | |
|---|---|
| ***F23R 3/00*** | (2006.01) |
| ***F23R 3/10*** | (2006.01) |
| ***F23R 3/50*** | (2006.01) |
| ***F23R 3/60*** | (2006.01) |
| ***F23R 3/28*** | (2006.01) |

(52) U.S. Cl.

CPC ..... *F23R 3/002* (2013.01); *F23R 3/10* (2013.01); *F23R 3/286* (2013.01); *F23R 3/50* (2013.01); *F23R 3/60* (2013.01); *F23R 2900/03042* (2013.01)

(58) Field of Classification Search

CPC .. F23R 3/002; F23R 3/10; F23R 3/286; F23R 3/06; F23R 2900/03042; F23R 2900/03041–03045; F23R 3/50

See application file for complete search history.

(56) References Cited

U.S. PATENT DOCUMENTS

| | | | | |
|---|---|---|---|---|
| 5,307,637 | A * | 5/1994 | Stickles | F23R 3/002 60/756 |
| 5,918,467 | A * | 7/1999 | Kwan | F23R 3/10 60/752 |
| 5,956,955 | A * | 9/1999 | Schmid | F23R 3/283 60/748 |
| 7,509,813 | B2 * | 3/2009 | Stastny | F23R 3/50 60/752 |
| 2006/0042263 | A1 * | 3/2006 | Patel | F23R 3/06 60/776 |
| 2007/0056289 | A1 * | 3/2007 | Sandelis | F23R 3/002 60/752 |
| 2013/0047621 | A1 * | 2/2013 | Carrere | F23R 3/002 60/752 |
| 2019/0048799 | A1 * | 2/2019 | Kishida | F01D 9/023 |

* cited by examiner

*Primary Examiner* — Todd E Manahan
*Assistant Examiner* — Katheryn A Malatek
(74) *Attorney, Agent, or Firm* — Rankin, Hill & Clark LLP

(57) ABSTRACT

Formed in a wall part of a dome part of an annular combustor encircling an axis of a gas turbine engine are multiple fuel supply holes spaced at predetermined intervals in circumferential direction around the axis and many cooling holes extending through the wall part in direction inclined to a normal thereof. When two adjacent fuel supply holes are defined as first and second fuel supply holes, a virtual boundary line contacting an outer semi-circular portion, far from the axis, of the first fuel supply hole and an inner semi-circular portion, close to the axis, of the second fuel supply hole is set. The first cooling holes in region radially outward, relative to the axis, of the line are inclined toward the second fuel supply hole, and the second cooling holes in region radially inward, relative to the axis, of the line are inclined toward the first fuel supply hole.

4 Claims, 5 Drawing Sheets

INNER SURFACE SIDE

STRUCTURE FOR COOLING GAS TURBINE ENGINE

BACKGROUND OF THE INVENTION

Field of the Invention

The present invention relates to a structure for cooling a gas turbine engine in which formed in a wall part of a dome part of an annular combustor encircling an axis of the gas turbine engine are a plurality of fuel supply holes spaced at predetermined intervals in a circumferential direction with the axis as a center and a large number of cooling holes extending through the wall part in a direction that is inclined with respect to a normal of the wall part.

Description of Related Art

Formed in a wall part of a dome part of a combustor of a conventional gas turbine engine are a large number of cooling holes that are inclined with respect to a normal of the wall part, a thin air layer being formed on an inner surface of the wall part of the combustor using air that has been introduced via the cooling holes, thus carrying out cooling of the dome part.

However, when a cooling hole that is inclined is formed in an area around a fuel supply hole formed in the dome part, if it is inclined so that a cooling hole outlet is far away from the fuel supply hole with respect to a cooling hole inlet, there is a possibility that a region (hot spot) in which cooling air does not flow will occur around the fuel supply hole on an inner surface of the dome part, which attains a high temperature, thus degrading durability of the combustor.

If the cooling hole around the fuel supply hole is inclined so that the cooling hole outlet is closer to the fuel supply hole with respect to the cooling hole inlet, although it is possible to prevent the hot spot from occurring around the fuel supply hole, this causes a problem that the hot spot will occur at a different place from the fuel supply hole (see FIG. 5).

The invention described in U.S. Pat. No. 5,307,637 eliminates the hot spot shown in FIG. 5 by inclining a cooling hole so that a cooling hole inlet is close to a fuel supply hole with respect to a cooling hole outlet, and also forms a cooling air layer around the fuel supply hole by making a canopy having an L-shaped cross section project so as to cover an outlet of the fuel supply hole and introducing cooling air thereto, thereby preventing occurrence of a hot spot over a whole surface of a dome part.

However, in the conventional arrangement described above, since it is necessary to make the canopy having an L-shaped cross section project in a vicinity of the fuel supply hole, there is a problem that a structure of a wall part of a combustor becomes complicated and the number of machining steps increases.

SUMMARY OF THE INVENTION

The present invention has been accomplished in light of the above circumstances, and it is an object thereof to achieve a balance between stable combustion of an air-fuel mixture in an interior of a combustor and cooling of a vicinity of a fuel supply hole of a dome part.

In order to achieve the object, according to a first aspect of the present invention, there is provided a structure for cooling a gas turbine engine in which formed in a wall part of a dome part of an annular combustor encircling an axis of the gas turbine engine are a plurality of fuel supply holes spaced at predetermined intervals in a circumferential direction with the axis as a center and a large number of cooling holes extending through the wall part in a direction that is inclined with respect to a normal of the wall part, wherein, when adjacent two of the fuel supply holes are defined as a first fuel supply hole and a second fuel supply hole, a virtual boundary line that is in contact with an outer semi-circular portion, far from the axis, of the first fuel supply hole and with an inner semi-circular portion, close to the axis, of the second fuel supply hole is set, the cooling holes positioned in a region that is radially outward, relative to the axis, of the virtual boundary line are inclined toward the second fuel supply hole, and the cooling holes positioned in a region that is radially inward, relative to the axis, of the virtual boundary line are inclined toward the first fuel supply hole.

In accordance with the first aspect, the plurality of fuel supply holes spaced at predetermined intervals in the circumferential direction with the axis as the center and the large number of cooling holes extending through the wall part in a direction that is inclined with respect to the normal of the wall part are formed in the wall part of the dome part of the annular combustor encircling the axis of the gas turbine engine. When two adjacent fuel supply holes are defined as the first fuel supply hole and the second fuel supply hole, the virtual boundary line that is in contact with an outer semi-circular portion, far from the axis, of the first fuel supply hole and with an inner semi-circular portion, close to the axis, of the second fuel supply hole is set, and since the cooling holes positioned in a region that is radially outward, relative to the axis, of the virtual boundary line are inclined toward the second fuel supply hole, and the cooling holes positioned in a region that is radially inward, relative to the axis, of the virtual boundary line are inclined toward the first fuel supply hole, it is possible, by generating a swirl flow in one direction by means of air passing through the cooling holes in the region radially outward of the virtual boundary line and by generating a swirl flow in another direction by means of air passing through the cooling holes in the region radially inward of the virtual boundary line, to stabilize combustion of an air-fuel mixture in the interior of the combustor. Moreover, since the cooling holes in the vicinity of the first and second fuel supply holes are formed so that the cooling hole outlet is inclined toward the first and second fuel supply holes with respect to the cooling hole inlet, it is possible, by preventing a hot spot from occurring by making the cooling hole outlets close to the whole of the circumference of the first and second fuel supply holes and also by preventing a hot spot from occurring over the whole surface of the dome part including the area around the first and second fuel supply holes, to enhance the cooling effect for the dome part.

According to a second aspect of the present invention, in addition to the first aspect, a first angle formed between a tangent at a contact of the virtual boundary line with the first fuel supply hole and a tangent at a radially outer end of the first fuel supply hole relative to the axis is substantially equal to a second angle formed between a tangent at a contact of the virtual boundary line with the second fuel supply hole and a tangent at a radially inner end of the second fuel supply hole relative to the axis.

In accordance with the second aspect, since the first angle formed between a tangent at the contact of the virtual boundary line with the first fuel supply hole and a tangent at the radially outer end of the first fuel supply hole relative to the axis is substantially equal to the second angle formed between a tangent at the contact of the virtual boundary line with the second fuel supply hole and a tangent at the radially inner end of the second fuel supply hole relative to the axis, it is possible to uniformly cool the vicinity of the first fuel supply hole and the vicinity of the second fuel supply hole.

According to a third aspect of the present invention, in addition to the second aspect, the first angle and the second angle are equal to or less than 25°.

In accordance with the third aspect, since the first angle and the second angle are equal to or less than 25°, it is possible to enable cooling holes to be machined by making the density of cooling hole inlets on the outer surface of the wall part a predetermined value or below while enabling effective cooling by making the density of cooling hole outlets on the inner surface of the wall part of the dome part a predetermined value or greater.

Note that a first fuel supply hole 13*a*-1 and a second fuel supply hole 13*a*-2 of an embodiment correspond to the fuel supply holes of the present invention, and a first cooling hole 13*b*-1 and a second cooling hole 13*b*-2 of the embodiment correspond to the cooling holes of the present invention.

The above and other objects, characteristics and advantages of the present invention will be clear from detailed descriptions of the preferred embodiment which will be provided below while referring to the attached drawings.

BRIEF DESCRIPTION OF THE DRAWINGS

FIG. 1 to FIG. 5 show an embodiment of the present invention:

FIG. 1 is a longitudinal sectional view of a combustor of a gas turbine engine;

FIG. 2 is a view from arrowed line 2-2 in FIG. 1;

FIG. 3 is a schematic diagram showing arrangement of cooling holes;

FIG. 5 is a diagram for explaining a reason for occurrence of a hot spot in a conventional example.

DESCRIPTION OF THE PREFERRED EMBODIMENT

An embodiment of the present invention is explained below by reference to FIG. 1 to FIG. 5.

Figure 1:
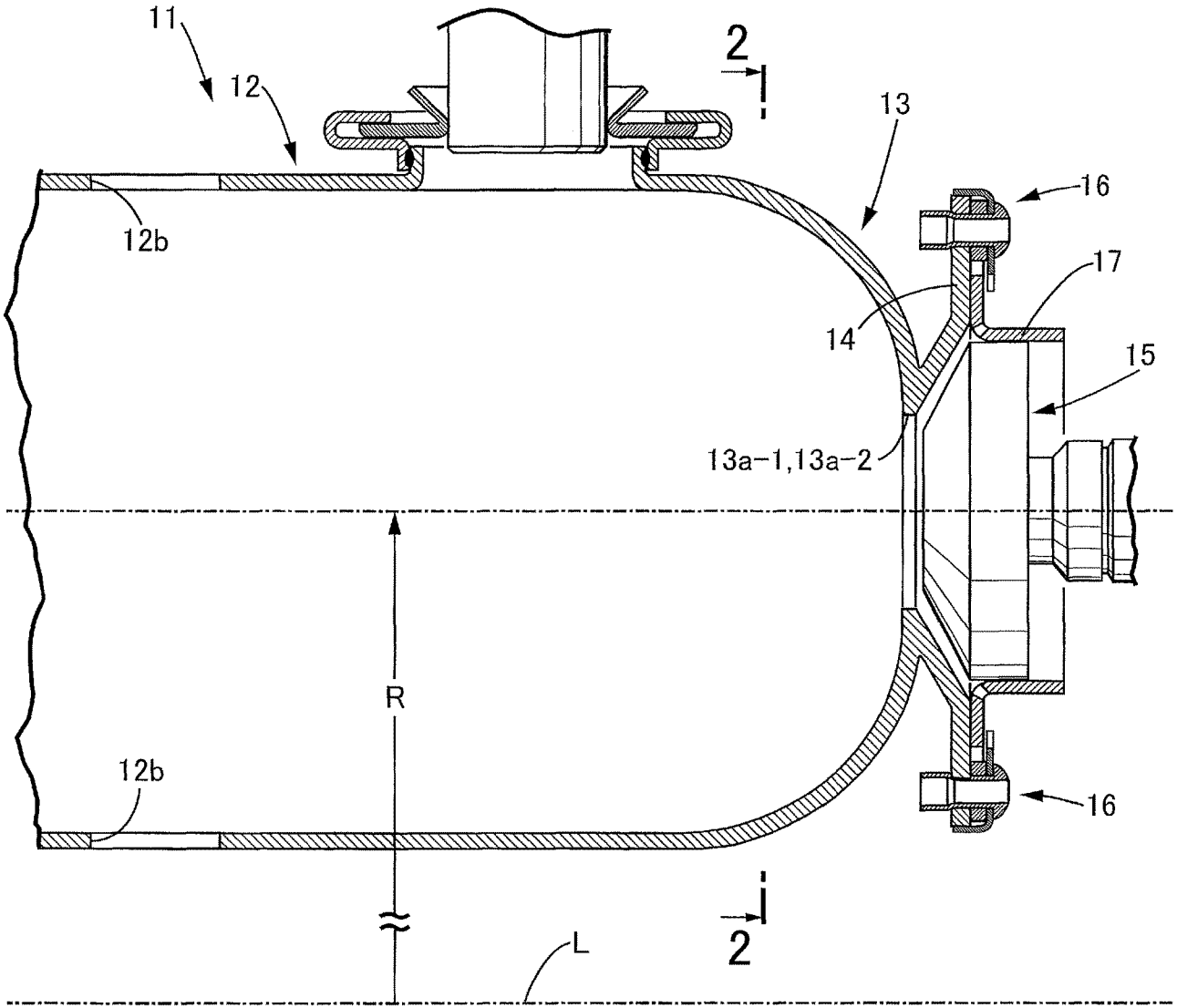

As shown in FIG. 1, a combustor 11 disposed so as to encircle an engine axis L of a gas turbine engine includes an annular combustor main body part 12 and a dome part 13 blocking one end part of the combustor main body part 12. A plurality of open flange parts 14 are disposed, at equal intervals on a circumference having the engine axis L as the center and having a radius R, on the semicircular cross section dome part 13, and the extremities of fuel nozzles 15 for injecting fuel into the interior of the combustor 11 via fuel supply holes 13*a* formed in the center of the open flange parts 14 are covered with nozzle guides 17 supported in a floating state by nozzle guide support means 16.

A structure for cooling the dome part 13 is now explained by reference to FIG. 2 and FIG. 3. A large number of cooling holes 13*b*-1 and 13*b*-2 are formed in a wall part of the dome part 13 so as to provide communication between the exterior and the interior thereof, and air that is supplied to the interior of the combustor 11 through these cooling holes 13*b*-1 and 13*b*-2 forms a thin air film on an inner surface of the dome part 13, thereby cooling the wall part of the dome part 13 and improving the durability. Although the cooling holes 13*b*-1 and 13*b*-2 are inclined at a predetermined angle with respect to a normal N of the wall part of the dome part 13 (see FIG. 3), the direction of inclination varies according to a region set on the wall part of the dome part 13.

That is, when two fuel supply holes that are adjacent in the circumferential direction are defined as a first fuel supply hole 13*a*-1 and a second fuel supply hole 13*a*-2 along a virtual arc 18 connecting center points of the two fuel supply holes, a virtual boundary line I that is in contact with an outer semi-circular portion far from the engine axis L in the first fuel supply hole 13*a*-1 and an inner semi-circular portion close to the engine axis L in second fuel supply hole 13*a*-2 is set. The virtual boundary I line intersects the virtual arc 18 at a position between the first and second fuel supply holes, an entirety of the virtual arc being disposed at a uniform distance from the engine axis L. The first cooling holes 13*b*-1 positioned in a region that is radially outward of the virtual boundary line I relative to the engine axis L are formed so that the cooling hole outlet is inclined toward the second fuel supply hole 13*a*-2 side with respect to the cooling hole inlet, and the second cooling holes 13*b*-2 positioned in a region that is radially inward of the virtual boundary line I relative to the engine axis L are formed so that the cooling hole outlet is inclined toward the first fuel supply hole 13*a*-1 side with respect to the cooling hole inlet. Arrows in FIG. 2 to FIG. 4 show the direction (the direction from the cooling hole inlet toward the cooling hole outlet) of inclination of the first cooling holes 13*b*-1 and the second cooling holes 13*b*-2.

Figure 2:
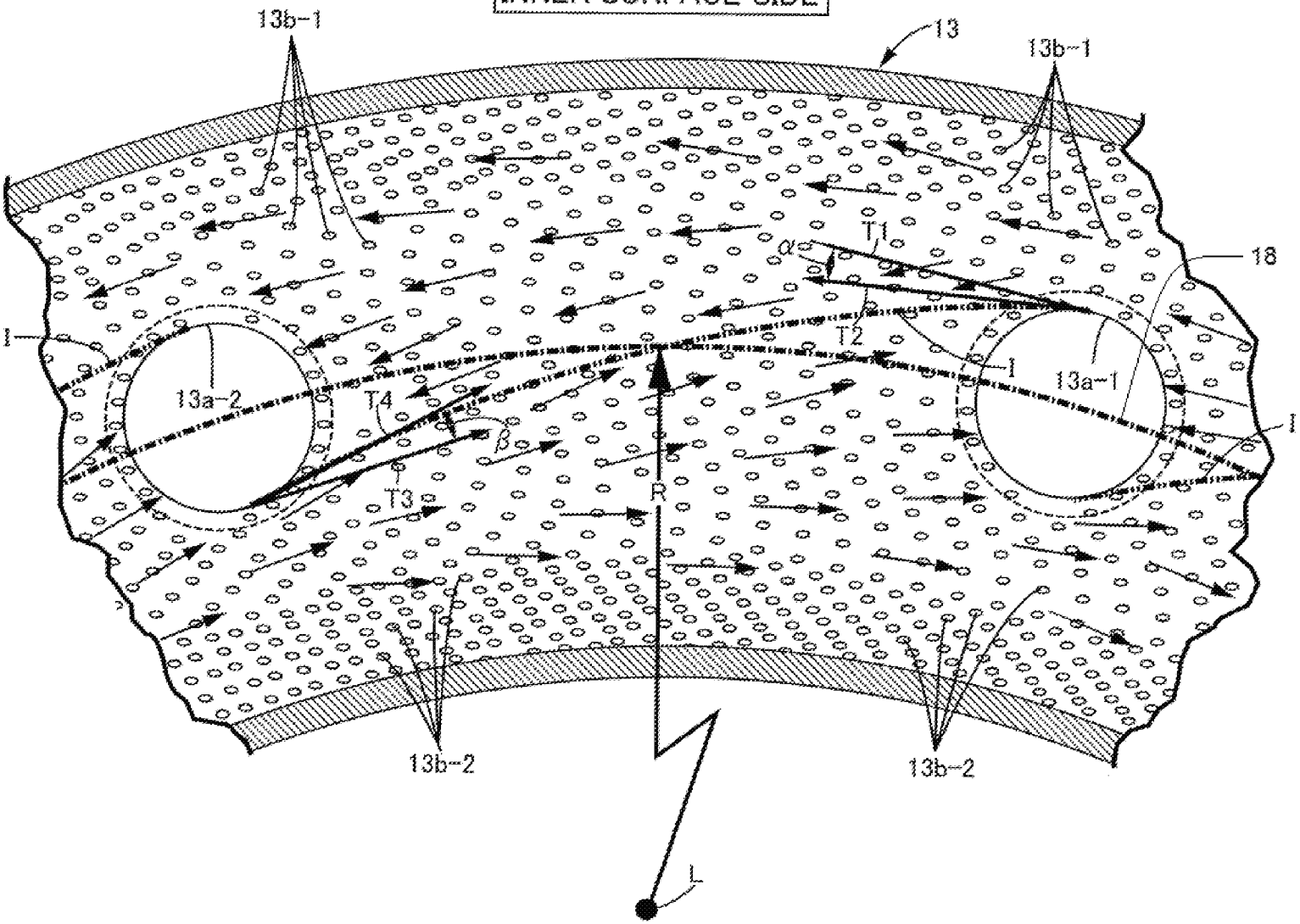

As shown in FIG. 2, a first angle $\alpha$ formed between a tangent T1 at the radially outer end, relative to the engine axis L, of the first fuel supply hole 13*a*-1 and a tangent T2 at a contact of the virtual boundary line I with the first fuel supply hole 13*a*-1 is set so as to be equal to a second angle $\beta$ formed between a tangent T3 at the radially inner end, relative to the engine axis L, of the second fuel supply hole 13*a*-2 and a tangent T4 at a contact of the virtual boundary line I with the second fuel supply hole 13*a*-2, that is, $\alpha=\beta$. In the present embodiment, the first angle $\alpha$ and the second angle $\beta$ are set so as to be equal to or less than 25°.

The operation of the embodiment of the present invention having the above arrangement is now explained.

During running of the gas turbine engine, air that has been compressed by a compressor is supplied to a space around the combustor 11 and is supplied therefrom to the interior of the combustor 11 after passing through the air inlet holes 12*b* of the combustor main body part 12, a cooling hole (not illustrated) of the combustor main body part 12, and the first and second cooling holes 13*b*-1 and 13*b*-2 of the dome part 13, the air is mixed with fuel injected from the fuel nozzle 15 in the interior of the combustor 11, and combustion is carried out. Combustion gas generated by the combustion is discharged from the combustor 11 and drives a turbine, and is then discharged via an exhaust nozzle and generates thrust.

Since the first cooling holes 13*b*-1 formed in the dome part 13 radially outward of the virtual boundary line I are inclined uniformly in the counterclockwise direction in FIG. 2 with respect to the normal N of the wall part of the dome part 13 when viewed from the engine axis L direction, air that has passed through the first cooling holes 13*b*-1 generates a swirl flow in the counterclockwise direction in FIG. 2 in a radially outward region in the interior of the combustor 11. Furthermore, since the second cooling holes 13*b*-2 formed in the dome part 13 radially inward of the virtual boundary line I are inclined uniformly in the clockwise direction in FIG. 2 with respect to the normal N of the wall part of the dome part 13 when viewed from the engine axis L direction, air that has passed through the second cooling holes 13*b*-2 generates a swirl flow in the clockwise direction in FIG. 2 in a radially inward region in the interior of the combustor 11. In this way, two swirl flows having different directions are generated in areas around the first and second fuel supply holes 13*a*-1 and 13*a*-2, thereby enabling stable combustion of the air-fuel mixture in the combustor 11.

Furthermore, if the first and second cooling holes 13*b*-1 and 13*b*-2 in the vicinity of the first and second fuel supply holes 13*a*-1 and 13*a*-2 are formed so that the cooling hole outlet is inclined toward the first and second fuel supply holes 13*a*-1 and 13*a*-2 with respect to the cooling hole inlet, the cooling hole outlet can be made closer to the outer periphery of the first and second fuel supply holes 13*a*-1 and 13*a*-2, and cooling air can be made to flow toward the outer periphery of the first and second fuel supply holes 13*a*-1 and 13*a*-2. However, if the cooling hole outlet were formed so as to be inclined toward the side opposite to the first and second fuel supply holes 13*a*-1 and 13*a*-2 with respect to the cooling hole inlet, not only would the cooling hole outlet move away from the outer periphery of the first and second fuel supply holes 13*a*-1 and 13*a*-2, but cooling air would also flow away from the outer periphery of the first and second fuel supply holes 13*a*-1 and 13*a*-2, and there is therefore a possibility that a hot spot where cooling is insufficient would occur on the outer periphery of the first and second fuel supply holes 13*a*-1 and 13*a*-2.

In accordance with the present embodiment, since the second cooling holes 13*b*-2 inclined toward the first fuel supply hole 13*a*-1 are disposed on a semicircular portion of the first fuel supply hole 13*a*-1 (the left half of the first fuel supply hole 13*a*-1 in FIG. 2 and the right half of the first fuel supply hole 13*a*-1 in FIG. 3), and the first cooling holes 13*b*-1 inclined toward the second fuel supply hole 13*a*-2 are disposed on a semicircular portion of the second fuel supply hole 13*a*-2 (the right half of the second fuel supply hole 13*a*-2 in FIG. 2 and the left half of the second fuel supply hole 13*a*-2 in FIG. 3), all of the first and second cooling holes 13*b*-1 and 13*b*-2 disposed on an area around the first and second fuel supply holes 13*a*-1 and 13*a*-2 are inclined while being directed to the first and second fuel supply holes 13*a*-1 and 13*a*-2, and it is possible by disposing the cooling hole outlets of the first and second cooling holes 13*b*-1 and 13*b*-2 so as to be close to the whole of the circumference of the first and second fuel supply holes 13*a*-1 and 13*a*-2 and by making cooling air flow in a direction toward the outer periphery of the first and second fuel supply holes 13*a*-1 and 13*a*-2, to prevent a hot spot from occurring.

The reason why the first and second angles α and β are restricted to be equal to or less than a predetermined value (25° in the present embodiment) is now explained by reference to FIG. 4.

Figure 3:
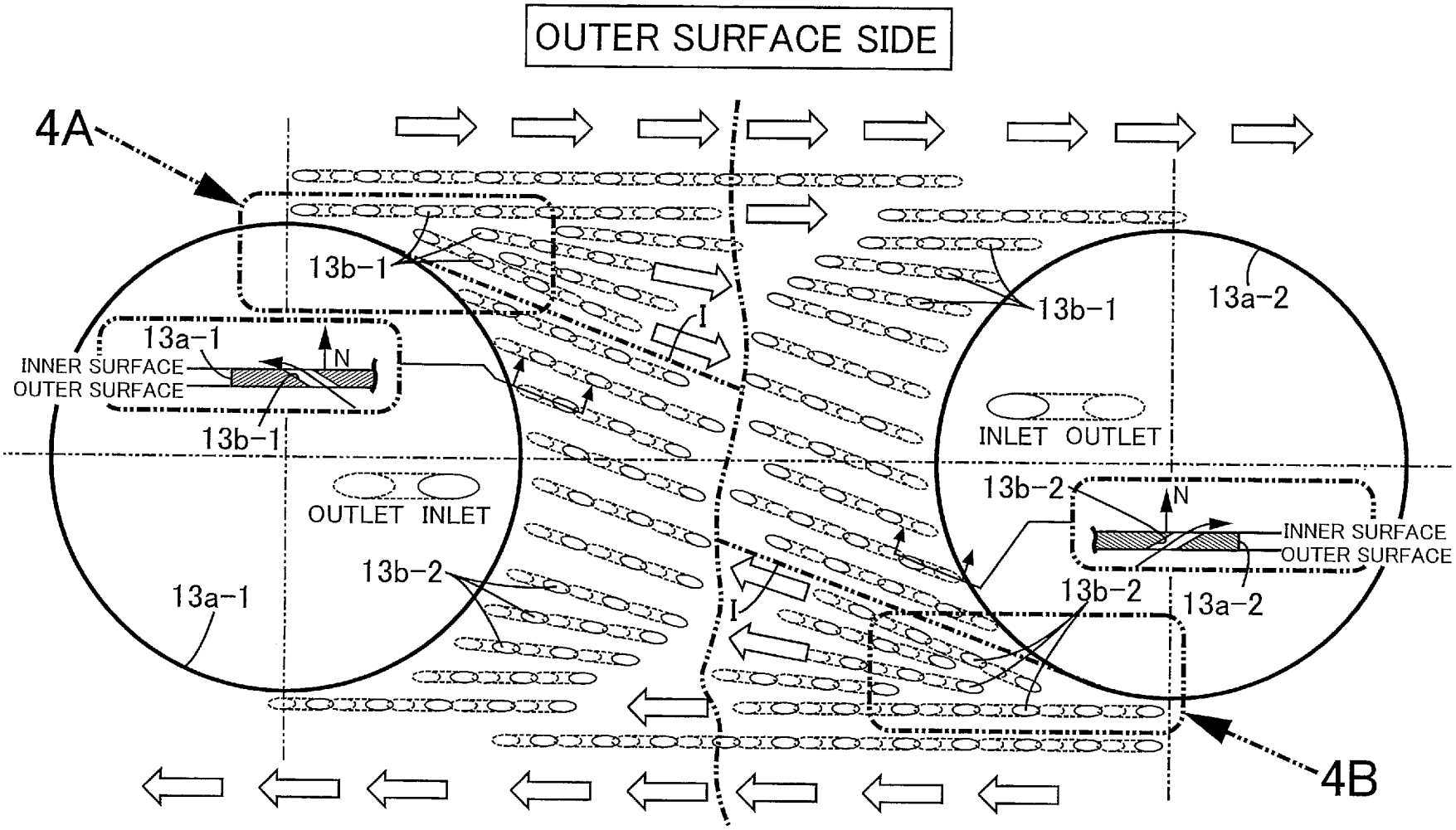
Figure 4A:
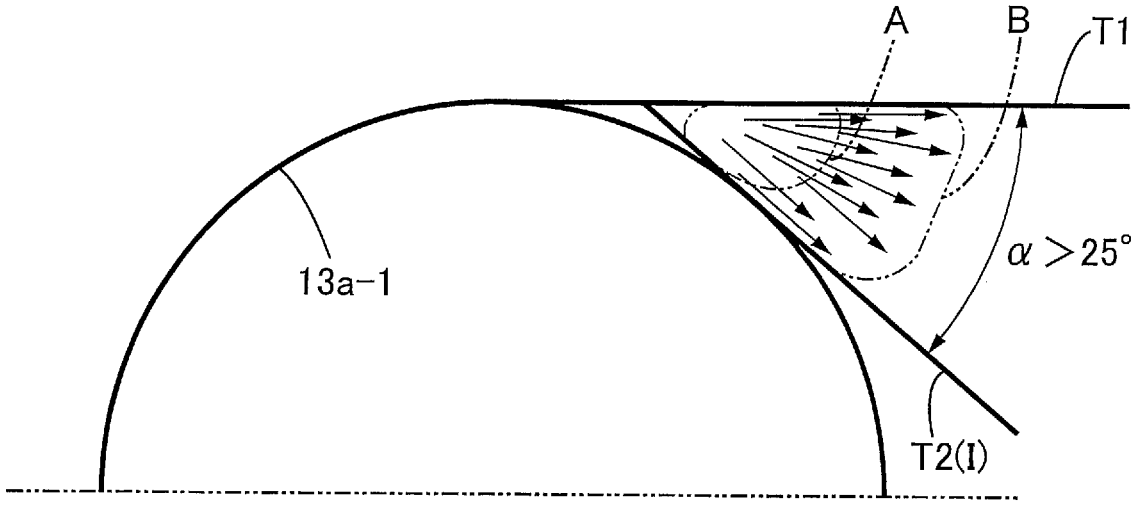
FIG. 4A and FIG. 4B are schematic diagrams corresponding to part 4A in FIG. 3.

FIG. 4A is a schematic diagram in which part 4A in FIG. 3 is enlarged, and corresponds to a case in which the first angle α exceeds 25'; in the vicinity of a section where the virtual boundary line I is in contact with the first fuel supply hole 13*a*-1, a predetermined number of first cooling holes 13*b*-1 extend from a cooling hole inlet (see start of arrow) where it opens to a region A to a cooling hole outlet (see end of arrow) where it opens to a region B. Since the ratio of the area of the region A relative to the area of the region B is small, if the cooling hole outlets are formed at a density that satisfies the cooling performance in the region B, the density of cooling hole inlets opening in the region A becomes high, and there is therefore the problem that machining of the first cooling holes 13*b*-1 becomes difficult.

Figure 4B:
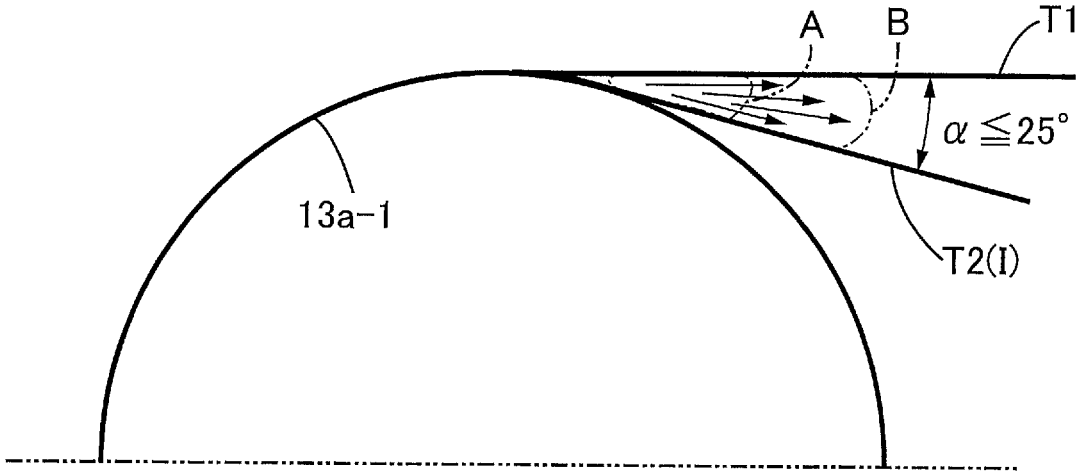
Figure 5:
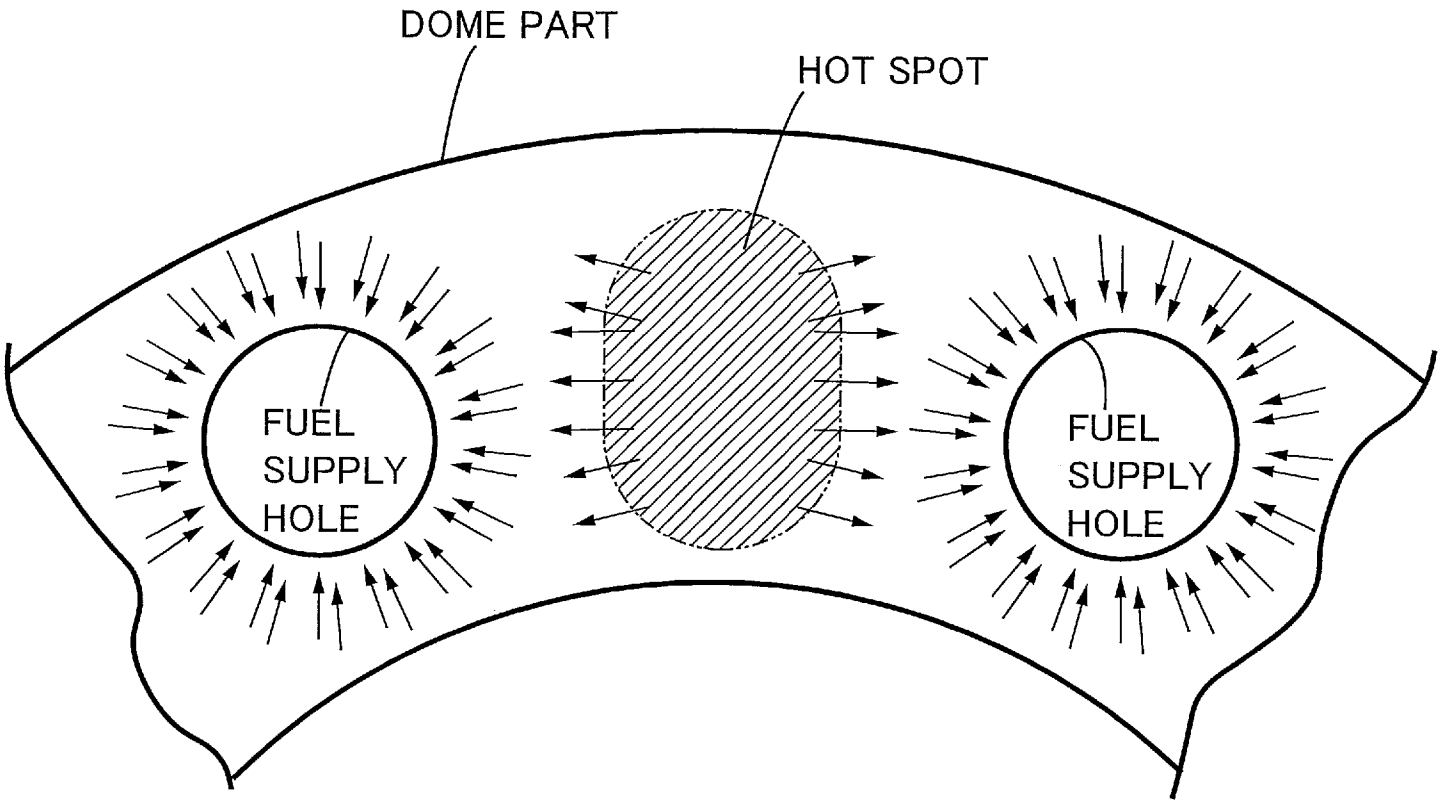

On the other hand, FIG. 4B is a schematic diagram in which part 4A of FIG. 3 is similarly enlarged, and corresponds to a case in which the first angle α is equal to or less than 25°; due to the first angle α being small, the ratio of the area of the region A relative to the area of the region B becomes large, even when the cooling hole outlets are formed at a density that satisfies the cooling performance in the region B, the density of cooling hole inlets opening in the region A becomes low, and it is therefore possible to carry out machining of the first cooling holes 13*b*-1.

The same applies to the second angle β of a section where the virtual boundary line I is in contact with the second fuel supply hole 13*a*-2 (see part 4B in FIG. 3), and setting the second angle β so as to be equal to or less than 25° makes it possible to ensure both the cooling performance and the ease of machining of the second cooling holes 13*b*-2.

Moreover, making the first angle α and the second angle β coincide with each other enables the cooling performance to be made uniform between the vicinity of the section where the virtual boundary line I is in contact with the first fuel supply hole 13*a*-1 and the vicinity of the section where the virtual boundary line I is in contact with the second fuel supply hole 13*a*-2.

An embodiment of the present invention is explained above, but the present invention may be modified in a variety of ways as long as the modifications do not depart from the gist thereof.

For example, the shape of the virtual boundary line I is not always the arc shape of the embodiment, and a virtual boundary line I may be formed from various types of curved and bent lines.

What is claimed is:

1. A structure for cooling a gas turbine engine in which formed in a wall part of a dome part of an annular combustor encircling an axis of the gas turbine engine are a plurality of fuel supply holes spaced at predetermined intervals in a circumferential direction with the axis as a center and cooling holes extending through the wall part in a direction that is inclined with respect to a normal of the wall part, each of the cooling holes including a cooling hole outlet and a cooling hole inlet, wherein, two adjacent fuel supply holes of the plurality of fuel supply holes are defined as a first fuel supply hole and a second fuel supply hole, a virtual boundary line is set which only makes contact with the first fuel supply hole at a first contact point and only makes contact with the second fuel supply hole at a second contact point, wherein the first contact point is located at an outer semi-circular portion of the first fuel supply hole at a point further from the axis than a center of the first fuel supply hole and the second contact point is located at an inner semi-circular portion of the second fuel supply hole at a point closer to the axis than a center of the second fuel supply hole, each of the cooling holes positioned radially outward, relative to the axis, of the virtual boundary line between the first contact point and the second contact point is formed so that each cooling hole outlet is closer to the second fuel supply hole than the respective cooling hole inlet, and each of the cooling holes positioned radially inward, relative to the axis, of the virtual boundary line between the first contact point and the second contact point is formed so that each cooling hole outlet is closer to the first fuel supply hole than the respective cooling hole inlet.

2. The structure for cooling the gas turbine engine according to claim 1, wherein a first angle formed between a tangent at the first contact point of the virtual boundary line with the first fuel supply hole and a tangent at a radially outermost end of the first fuel supply hole relative to the axis is substantially equal to a second angle formed between a tangent at the second contact point of the virtual boundary line with the second fuel supply hole and a tangent at a radially innermost end of the second fuel supply hole relative to the axis.

3. The structure for cooling the gas turbine engine according to claim 2, wherein the first angle and the second angle are equal to or less than 25°.

4. The structure for cooling the gas turbine engine according to claim 1, wherein the virtual boundary line intersects a virtual arc connecting the center points of the first and second fuel supply holes at a position between the first and second fuel supply holes, an entirety of the virtual arc being disposed at a uniform distance from the axis.

* * * * *